US007427957B2

(12) United States Patent
Zeinolabedin Rafi et al.

(10) Patent No.: US 7,427,957 B2
(45) Date of Patent: Sep. 23, 2008

(54) PATCH ANTENNA

(75) Inventors: Gholamreza Zeinolabedin Rafi, Kitchener (CA); Safieddin Safavi-Naeni, Waterloo (CA); Alastair Malarky, Petersburg (CA)

(73) Assignee: Mark IV IVHS, Inc., Flemington, NJ (US)

( * ) Notice: Subject to any disclaimer, the term of this patent is extended or adjusted under 35 U.S.C. 154(b) by 22 days.

(21) Appl. No.: 11/710,379

(22) Filed: Feb. 23, 2007

(65) Prior Publication Data

US 2008/0204326 A1 Aug. 28, 2008

(51) Int. Cl.
*H01Q 1/38* (2006.01)

(52) U.S. Cl. ..... 343/700 MS; 343/770

(58) Field of Classification Search ..... 343/700 MS, 343/767, 769, 770
See application file for complete search history.

(56) References Cited

U.S. PATENT DOCUMENTS 6,710,748 B2 * 3/2004 Yarasi et al. ..... 343/702
6,724,346 B2 * 4/2004 Le Bolzer et al. ..... 343/700 MS
6,876,328 B2 * 4/2005 Adachi et al. ..... 343/700 MS
7,038,631 B2 * 5/2006 Jecko et al. ..... 343/767
7,161,547 B2 * 1/2007 Yanagi et al. ..... 343/752
2004/0217907 A1 * 11/2004 Inoue ..... 343/728
2007/0085741 A1 4/2007 Rafi et al.
2007/0279286 A1 12/2007 Coutts et al.

* cited by examiner

*Primary Examiner*—Tan Ho
(74) *Attorney, Agent, or Firm*—Hanley, Flight & Zimmerman, LLC

(57) ABSTRACT

A patch antenna for achieving a vertically-polarized radiation pattern is described. The patch antenna includes a closed-curve slot within which a signal feed point is located. Parasitic slots are disposed outside or inside the closed-curve slot. In one embodiment, the closed-curve slot is a ring slot and the parasitic slots are arc slots having a common center point with the ring slot. The antenna may further include a lower patch capable of producing a different radiation pattern with different polarization and at a different frequency band, to result in a dual-band antenna. The dual-band antenna may operate in the 5.9 GHz DSRC and 1.575 GHz GPS bands.

23 Claims, 4 Drawing Sheets

PATCH ANTENNA

FIELD OF THE INVENTION

The present invention relates to patch antennas and, in particular, to a vertically-polarized patch antenna.

BACKGROUND OF THE INVENTION

The proliferation of radio-frequency based technology, such as cellular telephones, RFID devices, and other wireless devices, has led to a number of developments in antenna design. One popular antenna type is the patch antenna, whereby a radiating patch is positioned parallel to and spaced apart from a ground plane. A dielectric substance is placed between the patch and the ground plane. Signals may be provided to the patch, and incoming signals may be obtained, through a feed mechansim. Typical feed mechanisms for patch antennas include one or more coaxial feeds extending through the dielectric material, or an embedded planar feed line connected or electromagnetically coupled to the patch, or an aperture coupled feed.

At present, standards have been developed that apply to communication in a number of different frequency bands, sometime for different purposes or applications. Example standards include GPS, GPRS, 2.4 GHz WLAN, 5.8 GHz WLAN, and the new 5.9 GHz DSRC (Dedicated Short Range Communications) bands.

Existing patch antennas have difficulty in achieving certain desirable characteristics, such as vertical polarization relative to a horizontal patch position, uniform radiation pattern in azimuth, or significant antenna gain at zero elevation degrees (or $\theta=90°$), i.e. in the horizontal plane of the antenna.

It would be advantageous to provide an improved patch antenna.

SUMMARY OF THE INVENTION

The present invention provides a patch antenna for radio frequency communications. In particular, the present application discloses a patch antenna for achieving a vertically-polarized radiation pattern. The patch antenna includes a closed-curve slot defining an interior area, which is connected or coupled to a signal feed mechanism. Parasitic slots are disposed proximate but spaced apart from the closed-curve slot. In one embodiment, the closed-curve slot is a ring slot and the parasitic slots are arc slots having a common center point with the ring slot. The antenna may further include a lower patch resonant at a different frequency band and capable of producing another radiation pattern having a different polarization from the vertically-polarized radiation pattern, to result in a dual-band antenna. The dual-band antenna may operate in the 5.9 GHz DSRC and 1.575 GHz GPS bands.

In one aspect, the present invention provides a patch antenna that includes a conductive patch having a closed-curve slot and a plurality of parasitic slots, and wherein the parasitic slots are spaced apart from the perimeter of the closed-curve slot. The closed-curve slot defines an inner portion of the conductive patch. The antenna also includes a ground plane parallel to and spaced apart from the conductive patch, a dielectric substrate disposed between the conductive patch and the ground plane, and a feed mechanism adapted to supply an excitation signal to the inner portion of the conductive patch.

In another aspect, the present invention provides a dual-band antenna. The antenna includes a top conductive patch having defined therein a closed-curve slot and a plurality of parasitic slots, the plurality of parasitic slots being spaced apart from the perimeter of the closed-curve slot. The closed-curve slot defines an inner portion of the top conductive patch. It also includes a ground plane parallel to and spaced apart from the top conductive patch, a lower conductive patch parallel to and between the top conductive patch and the ground plane, a first dielectric substrate disposed between the top conductive patch and the lower conductive patch and a second dielectric substrate disposed between the lower conductive patch and the ground plane. The antenna features a first feed mechanism adapted to excite the inner portion of the top conductive patch, and a second feed mechanism adapted to excite the lower conductive patch. The first feed mechanism and the top conductive patch are configured to provide the top conductive patch with a first polarized radiation pattern. The lower conductive patch and the second feed are configured to provide the lower conductive patch with a second polarized radiation pattern different from said first polarized radiation pattern).

In yet another aspect, the present invention provides a dual-band antenna with a top conductive patch having defined therein a circular slot and four parasitic slots, the four parasitic slots being disposed outside the perimeter of the circular slot and spaced apart therefrom, the four parasitic slots being arc slots having a common radial center with the circular slot and having a length less than their radius times $\pi/2$. The antenna also includes a rectangular ground plane, parallel to and spaced apart from the top conductive patch, a polygonal lower conductive patch parallel to and between the top conductive patch and the ground plane, a first rectangular dielectric substrate disposed between the top conductive patch and the lower conductive patch, and a second rectangular dielectric substrate disposed between the lower conductive patch and the ground plane. The antenna has a first feed mechanism adapted to excite the top conductive patch at the common radial center, and a second feed mechanism adapted to excite the lower conductive patch.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show embodiments of the present invention, and in which.

Similar reference numerals are used in different figures to denote similar components.

DESCRIPTION OF SPECIFIC EMBODIMENTS

The following description makes reference to the radiating element of the antenna being a "conductive" patch. In many embodiments, the patch may be formed from a metal or metal alloy; however, in some embodiments, the patch may be formed from non-metallic electrical conductors such as superconductors. There are also other types of non-metallic electrical conductors that may be used in some specific embodiments. Accordingly, references herein to a "conductive patch" may be understood as including metallic and non-metallic electrical conductors.

The following description also makes reference to feed points and, in particular, coaxial feed probes connected to a patch. It will be appreciated that other feed mechanisms may be used in other embodiments. For example, particular embodiments may use microstrip feeds, coplanar waveguide feeds, electromagnetic coupling feeds, and/or aperture coupling feeds. The selection of a suitable feed mechanism for a particular application will be within the competence of a person of ordinary skill in the art.

Figure 1:
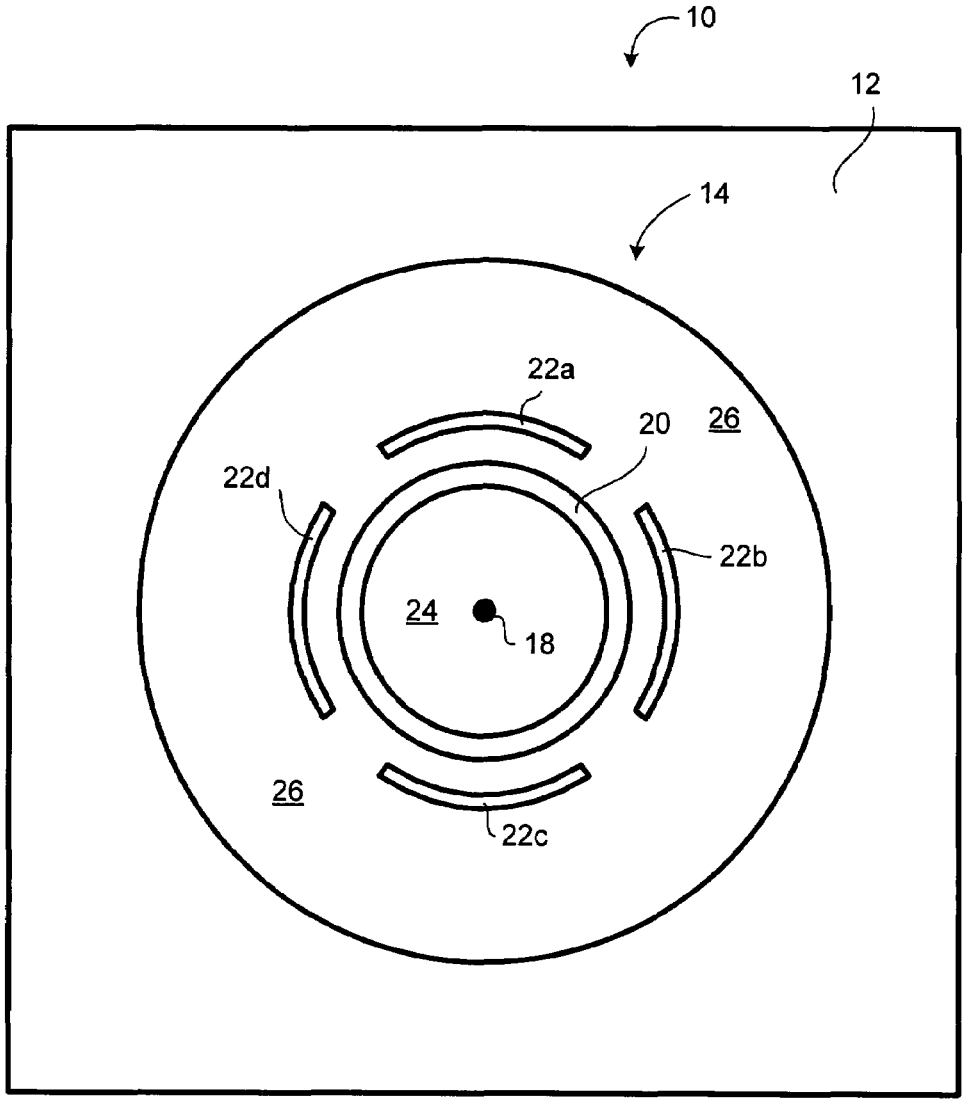
FIG. 1 diagrammatically shows a top plan view an embodiment of a patch antenna.
Figure 2:
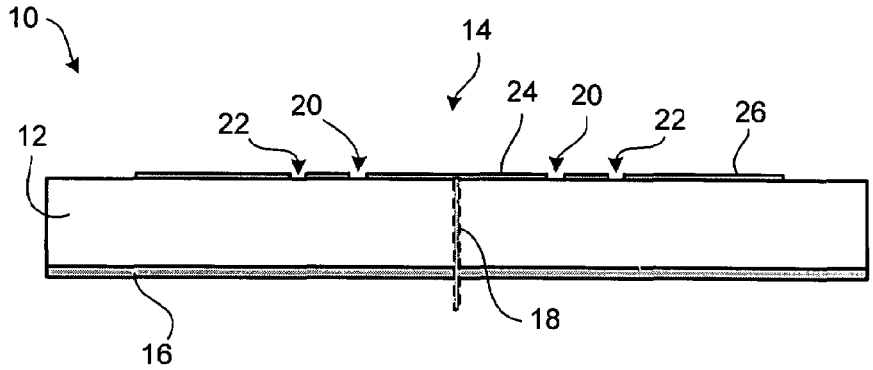
FIG. 2 shows a cross-sectional view of the patch antenna of FIG. 1.

Reference is first made to FIG. 1, which shows a top plan view of an embodiment of a patch antenna 10, and FIG. 2, which shows a cross-sectional view of the patch antenna 10 of FIG. 1.

The antenna 10 includes a ground plane 16 and a conductive patch 14. The conductive patch 14 is parallel to and spaced apart from the ground plane 16. A dielectric material 12 fills the space between the ground plane 16 and the conductive patch 14. The ground plane 16 is larger than the conductive patch 14 so as to approximate an infinite ground plane; however, the actual size of the ground plane 16 may be limited by design considerations and physical space limitations. In one embodiment, the conductive patch 14 is circular. Other embodiments may employ other shapes; however the circular conductive patch 14 used in this embodiment assists in achieving uniformity of the radiation pattern in azimuth.

In one embodiment, a feed probe 18 is connected to the underside of the circular conductive patch 14. The feed probe 18 extends up through the ground plane 16 and the dielectric material 12. The feed probe 18 is connected to the center of the circular conductive patch 14. As noted above, other embodiments may employ other types of feed mechanism such as, for example, connected or electromagnetically coupled planar lines, or aperture coupling.

A closed-curve slot is defined in the circular conductive patch 14. In this embodiment, the closed-curve slot is a circular slot 20. Again, the shape of the closed-curve slot need not be circular, although in some embodiments the circularity of the slot may assist in achieving uniformity of the radiation pattern. The circular slot 20 is disposed on the circular conductive patch 14 such that the feed probe 18 is centered within it. In the present embodiment, both the circular slot 20 and the feed probe 18 are centered within the circular conductive patch 14. The circular slot 20 divides the circular conductive patch 14 into an inner portion 24 and an outer portion 26.

The feed probe 18 is centered within the inner portion 24 of the circular conductive patch 14. The placement of the feed probe 18 at a central point within the closed-curve slot assists in generating a vertically-polarized radiation pattern. It will be appreciated that if the patch and/or the closed-curve slot are not circular or symmetrical in shape then the feed point may not be at the center point.

It has been found that the radiation pattern developed by a conductive patch 14 having a closed-curve slot radiator, like the circular slot 20, is sensitive to the geometry of the underlying dielectric and ground plane, like dielectric material 12 and ground plane 16. Improvements to uniformity of the radiation pattern may be achieved by shaping the dielectric material and ground plane so as to minimize their non-uniform distortion of the radiation pattern; for example, by shaping them to be circular like the conductive patch 14. However, practical limitations make it difficult to use circularly cut dielectric material. Current mass production technologies make it prohibitively difficult and expensive to manufacture curved shaped dielectric material. Accordingly, the dielectric material 12 in the present embodiment is rectangular. In particular, the dielectric material 12 and the underlying ground plane 16 are square in the present embodiment. This results in non-uniform distortions of the radiation pattern of the circular conductive patch 14 in azimuth.

As will be described in greater detail below, some embodiments of the antenna 10 may include other elements, including other radiating elements that may also cause non-uniform distortions of the radiation pattern of the circular conductive patch 14.

Referring still to FIGS. 1 and 2, the present embodiment of the antenna 10 provides for a plurality of parasitic slots 22 (individually labeled 22*a*, 22*b*, 22*c*, and 22*d*). The parasitic slots 22 are formed in the outer portion 26 of the circular conductive patch 14, spaced apart from the circular slot 20. In the present embodiment, the parasitic slots 22 are symmetrically disposed around the circular slot 20. The parasitic slots 22 assist in improving the symmetry/uniformity of the radiation pattern in azimuth. In effect, the parasitic slots 22 partly counter the non-uniform distortions caused by the dielectric 12, the ground plane 16, and some other non-circular elements. For non-circular patches or non-circular closed-curve slots, the parasitic slots may not placed symmetrically on the patch.

The precise shape and configuration of the parasitic slots 22 in any particular embodiment may be adjusted to optimize the effect that the parasitic slots 22 have in countering or balancing any specific non-uniform pattern distortions that arise in that embodiment. For example, with a dielectric having a different shape that the dielectric material 12 of the present embodiment, the effect of the parasitic slots 20 may be further optimized by adjusting their shape or location relative to the circular slot 20. In some embodiments, they may not be symmetrically located around the closed-curve slot.

In the present embodiment, the parasitic slots 22 are arcs having a common radial point with the radial center of the circular slot 20. The parasitic slots 22 are symmetrically distributed around the circular slot 20 and each arc is of a length less than $r \cdot \pi/2$, where r is the radius of the slot, i.e. the slots 22 traverse less than 90 degrees. Each parasitic slot 22 is disposed at a midpoint with regard to a side of the square dielectric material 12, leaving gaps between the endpoints of the slots 22. The gaps are centered along the corner axes of the square dielectric material 12.

It will be appreciated that further adjustments to size, shape, number, or placement of the parasitic slots 22 may result in further optimization of the effect of the slots 22 in improving the uniformity of the radiation pattern of the antenna 10. Moreover, changes to the shape or placement of the dielectric material 12 or the ground plane 10, or the addition of other elements to the antenna 10 may leads to further opportunities to optimally adjust the size, shape, number, or placement of the parasitic slots 22. It will be appreciated that changes to the shape or configuration of the closed-curve slot may also give rise to changes in the size, shape, number and/or placement of the parasitic slots 22.

The circular slot 20 and parasitic slots 22 of the present embodiment give rise to a vertically-polarized radiation pattern. They also provide the antenna 10 with a reasonable gain at zero elevation degrees (or $\theta=90°$), i.e. in the horizontal plane of the antenna.

Figure 3:
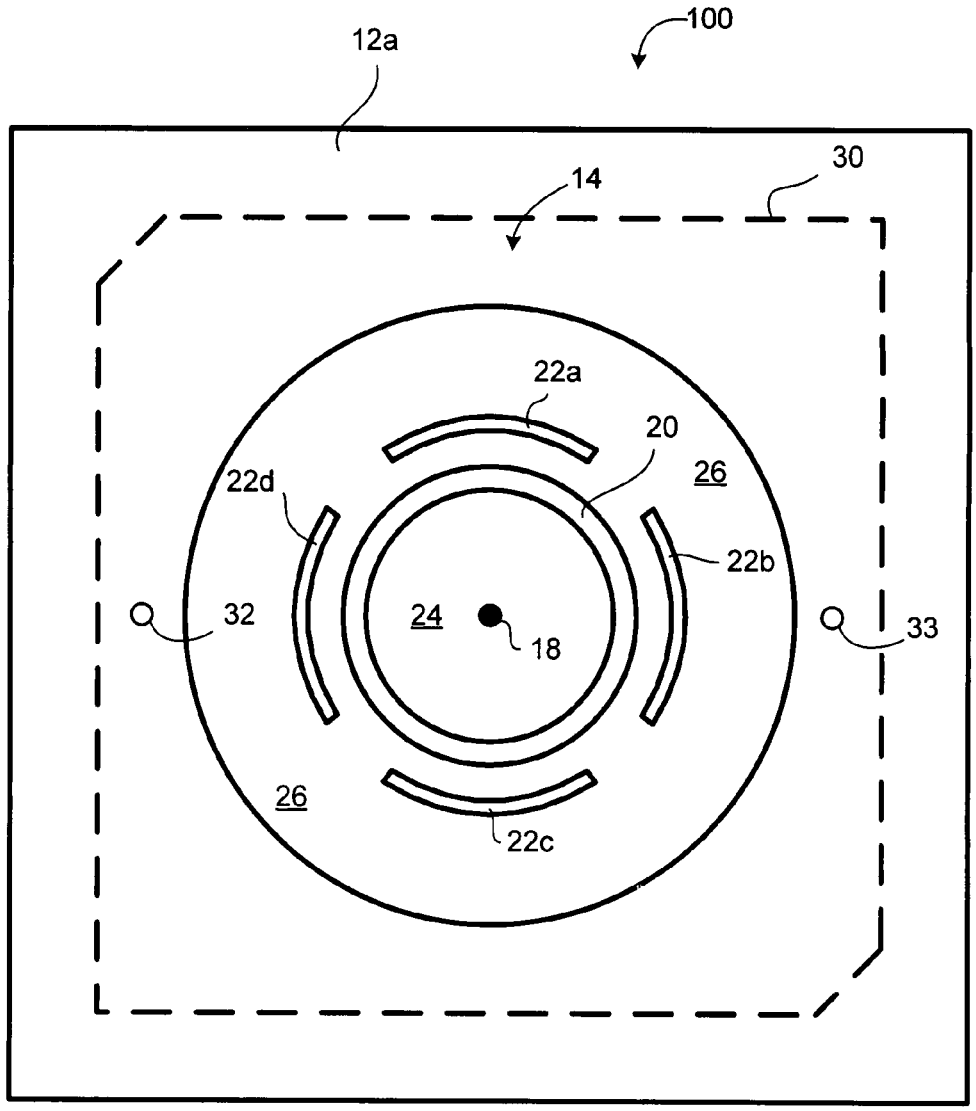
FIG. 3 diagrammatically shows a top plan view an embodiment of a dual-band patch antenna.
Figure 4:
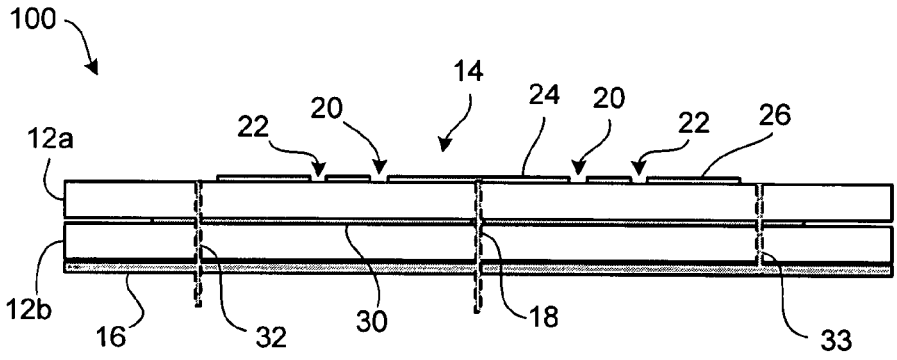
FIG. 4 shows a cross-sectional view of the dual-band patch antenna of FIG. 3.

Reference is now made to FIGS. 3 and 4 which show an embodiment of a dual-band antenna 100. FIG. 3 shows a plan view of the dual-band antenna 100 and FIG. 4 shows a cross-sectional view of the dual-band antenna 100.

The dual-band antenna 100 includes the ground plane 16, the circular conductive patch 14, and the dielectric material, although in this embodiment the dielectric material includes an upper dielectric material 12*a* and a lower dielectric material 12*b*. A second conductive patch 30 is disposed between the upper and lower dielectric materials 12*a*, 12*b*, to produce a stacked patch planar antenna configuration.

The second conductive patch 30 is connected to one or more feed probes 32. The second conductive patch 30 and the one or more feed probes 32 are configured so as to give rise to a different radiation pattern from the radiation pattern of the circular conductive patch 14 and at a different resonant frequency from the resonant frequency of the circular conductive patch 14. In this embodiment, the second conductive patch 30 is configured to give rise to a circular polarized radiation pattern, which differs from the vertically-polarized radiation pattern generated by the circular conductive patch 14.

In the embodiment shown in FIGS. 3 and 4, the single feed probe 32 is formed as a through via instead of a blind via. While a blind via may be practical for some embodiments, in at least one implementation fabrication limitations make it easier to use a through via. In this embodiment, it is possible to use a through via because the feed probe 32 is disposed in a location outside the perimeter of the circular conductive patch 14. A dummy through via 33 is also connected to the second conductive patch 30 in this embodiment. The dummy through via 33 is placed symmetrically across the center point from the single feed probe 32, so as provide for symmetry in any distortions in the radiation patterns that may result from the presence of the two through vias. Of course, it will be understood that the feed probes 18, 32, which in this case are implemented using through vias, are connected to circuitry, such as for example a transceiver or other signal processing circuitry, typically located below the ground plane 16. The dummy through via 33 is not connected to the underlying circuitry and is not for receiving or supplying excitation signals to the antenna 100.

In the embodiment shown in FIGS. 3 and 4, the circular polarized radiation pattern is achieved through using a single-fed corner-cut rectangular patch as the second conductive patch 30. The second conductive patch 30 in the present embodiment results in a roughly hemispherical radiation pattern.

Other embodiments may employ other types of radiating elements. For example, a circular polarized radiation pattern may be achieved through a quadrature phase-shifted dual-feed patch, a single-fed pentagonal patch, or a number of other configurations. Those skilled in the art will appreciate the range of patch antennas and feeds that may be used to generate a circular polarized field.

As explained above, the size, shape, and location of the parasitic slots 22 and/or the closed-curve slot within the circular conductive patch 14 may be adjusted so as to reduce the effect of the second conductive patch 30 in distorting the pattern of the circular conductive patch 14. Such adjustments may also be made to reduce cross-coupling between the feeds to the two patches 14, 30. In the present embodiment, the use of a single fed corner-cut square patch for the second conductive patch 30 assists in achieving pattern uniformity in both modes, and for achieving circular polarization purity and minimizing cross-coupling between the two patches.

The impedance matching circuits (not shown) for both the circular conductive patch, and a portion of the RF front end electronics may, in some embodiments, be placed on the dielectric substrate (not shown) on the underside of the ground plane 16.

In one embodiment, the dual-band antenna 100 may be implemented so as to provide for operation in the GPS and DSRC frequency bands. For example, the second conductive patch 30 may be configured to have a resonant frequency at about 1.575 GHz for GPS, and the circular conductive patch 14 may be configured to have a resonant frequency at about 5.9 GHz (DSRC).

Figure 5:
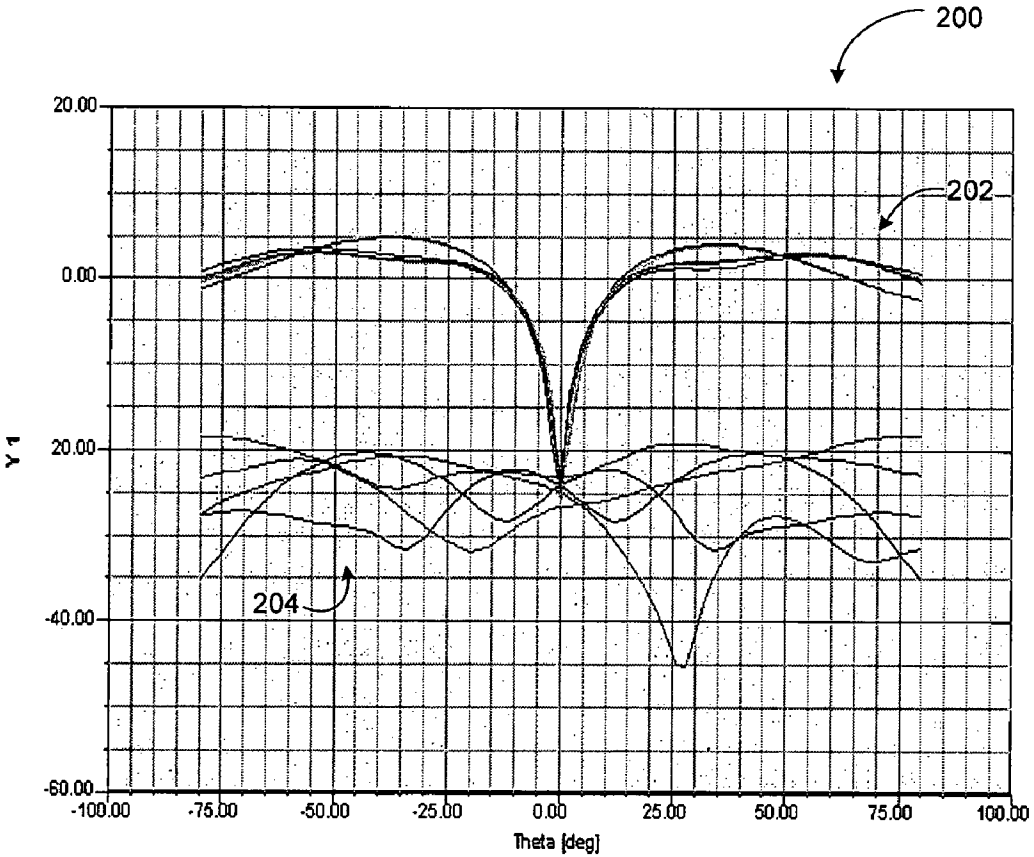
FIG. 5 shows, in graph form, the radiation pattern at 5.9 GHz DSRC for the dual-band antenna of FIG. 3.

Reference is now made to FIG. 5, which, in graph 200, depicts the radiation pattern at 5.9 GHz DSRC of the dual-band antenna 100 of FIG. 3. The graph 200 includes a plurality of curves 202 at various azimuths; and, in particular, at Phi=0, 45, 90, 135, and 180 degrees. The curves 204 reflect the horizontal cross-polarization levels at the same azimuth settings.

Figure 6:
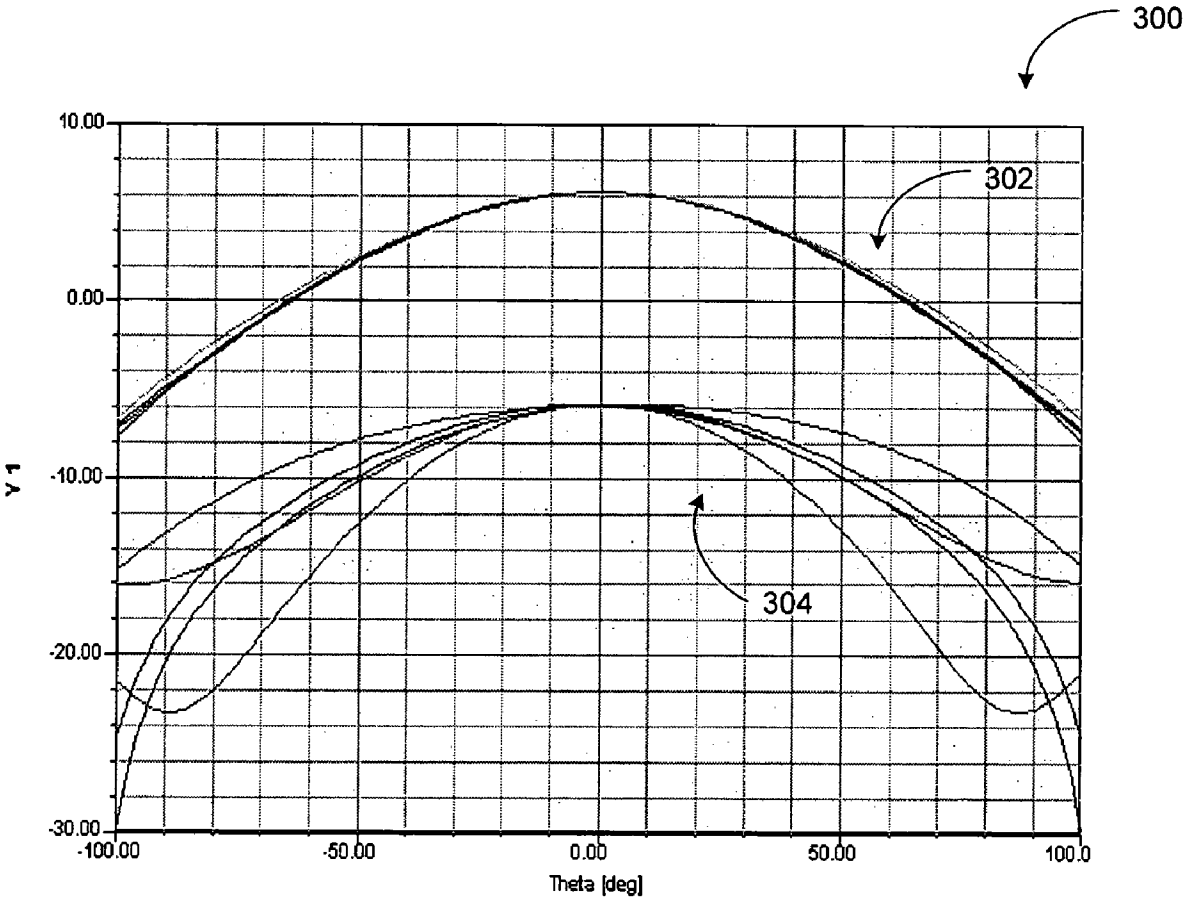
FIG. 6 shows, in graph form, the radiation pattern at 1.575 GHz GPS for the dual-band antenna of FIG. 3.

Reference is also made to FIG. 6, which, in graph 300, depicts the radiation pattern at 1.575 GHz GPS for the dual-band antenna 100 of FIG. 3. The graph 300 includes a set of curves reflecting measurements at various azimuths; and, in particular, at Phi=0, 45, 90, 135, and 180 degrees. Curves 302 reflect right-hand circular polarization measurements and curves 304 reflect left-hand circular polarization measurements.

The DSRC standards development is focused on applications involving vehicle-to-roadside and vehicle-to-vehicle short range communications. Commercial applications for the technology may include Commercial Vehicle Operations (CVO), Electronic Toll Collection (ETC), automated payment, collision avoidance, and others. In many cases, the antenna for DSRC communications is intended to be mounted on a windsheild or rooftop of a vehicle. As a result, the ability to provide a vertical polarized uniform radiation pattern with reasonable antenna gain at 90 degrees Theta is advantageous, given that many other vehicles and roadside readers may have antennas located at or near 90 degrees Theta relative to other antennas.

GPS communications are already commonplace within vehicles for map and direction-assistance applications.

The dual-band antenna 100, which provides both GPS and DSRC capabilities, is particularly advantageous in that it allows both GPS and DSRC applications to be implemented via a single antenna device, thereby permitting the applications to be integrated into a single on-board unit (OBE).

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A patch antenna comprising:

a conductive patch having a closed-curve slot and a plurality of parasitic slots, wherein said parasitic slots are spaced apart from the perimeter of the closed-curve slot, and wherein the closed-curve slot defines an inner portion of the conductive patch;

a ground plane parallel to and spaced apart from the conductive patch;

a dielectric substrate disposed between the conductive patch and the ground plane; and a feed mechanism adapted to supply an excitation signal to the inner portion of the conductive patch.

2. The patch antenna claimed in claim 1, wherein said parasitic slots are disposed relative to the closed-curve slot in locations in which the parasitic slots act to counterbalance non-uniform radiation pattern distortions caused by said ground plane or said dielectric substrate.

3. The patch antenna claimed in claim 2, wherein said parasitic slots are disposed around the outer perimeter of said closed-curve slot.

4. The patch antenna claimed in claim 3, wherein said closed-curve slot comprises a circular slot having a radial center at a point at which the feed mechanism excites the inner portion of the conductive patch.

5. The patch antenna claimed in claim 4, wherein each of said parasitic slots comprises an arc slot, each arc slot having a radius of curvature centered at the said radial center, and wherein each arc slot has a length less than its radius times $\pi/2$.

6. The patch antenna claimed in claim 1, wherein said closed-curve slot comprises a circular slot having a radial center at the point at which the feed mechanism excites the inner portion of the conductive patch.

7. The patch antenna claimed in claim 6, wherein said conductive patch comprises a circular conductive patch.

8. The patch antenna claimed in claim 1, wherein said feed mechanism, said conductive patch, said closed-curve slot, and said parasitic slots are configured to provide said conductive patch with a vertically-polarized radiation pattern.

9. The patch antenna claimed in claim 1, wherein conductive patch comprises a top conductive patch, said dielectric material includes an upper layer of dielectric material and a lower layer of dielectric material, and wherein the antenna further comprises a lower conductive patch disposed between said upper layer and said lower layer, and at least one other feed mechanism, which is adapted to excite said lower conductive patch.

10. The patch antenna claimed in claim 9, wherein said lower conductive patch comprises a corner-cut rectangular patch, and wherein said at least one feed mechanism comprises a single feed point, and wherein said lower conductive patch has a circular polarized radiation pattern.

11. The patch antenna claimed in claim 9, wherein said top conductive patch is configured to have a resonant frequency at about 5.9 GHz DSRC and said lower conductive patch is configured to have a resonant frequency at about 1.575 GHz GPS.

12. A dual-band antenna comprising:

a top conductive patch having defined therein a closed-curve slot and a plurality of parasitic slots, the plurality of parasitic slots being spaced apart from the perimeter of said closed-curve slot, and wherein the closed-curve slot defines an inner portion of the top conductive patch;

a ground plane parallel to and spaced apart from the top conductive patch;

a lower conductive patch parallel to and between the top conductive patch and the ground plane;

a first dielectric substrate disposed between the top conductive patch and the lower conductive patch;

a second dielectric substrate disposed between the lower conductive patch and the ground plane;

a first feed mechanism adapted to excite the inner portion of the top conductive patch; and a second feed mechanism adapted to excite the lower conductive patch, wherein said first mechanism and said top conductive patch are configured to provide said top conductive patch with a first polarized radiation pattern, and wherein the lower conductive patch and the second feed mechanism are configured to provide said lower conductive patch with a second polarized radiation pattern different from said first polarized radiation pattern.

13. The dual-band antenna claimed in claim 12, wherein said first polarized radiation pattern comprises a vertically-polarized radiation pattern, and wherein said second polarized radiation pattern comprises a circular-polarized radiation pattern.

14. The dual-band antenna claimed in claim 13, wherein said closed-curve slot comprises a circular slot having a radial center at a point at which the first feed mechanism excites said inner portion.

15. The dual-band antenna claimed in claim 14, wherein said parasitic slots comprise arc slots having their radial centers at the radial center of said circular slot.

16. The dual-band antenna claimed in claim 15, wherein said parasitic slots are disposed around an outer perimeter of the circular slot.

17. The dual-band antenna claimed in claim 12, wherein said first and second dielectric substrates are rectangular and wherein said parasitic slots comprise four parasitic slots, each parasitic slot being disposed along one of the sides of the rectangular dielectric substrate.

18. The dual-band antenna claimed in claim 17, wherein said ground plane and said lower conductive patch are both substantially rectangular and centered with respect to said first and second dielectric substrates and with respect to said top conductive patch.

19. The dual-band antenna claimed in claim 18, wherein said top conductive patch comprises a circular conductive patch, said closed-curve slot comprises a circular slot, said dielectric substrates and said ground plane are rectangular, and wherein said parasitic slots comprise four arc slots each having a common radial center with said circular slot.

20. The dual-band antenna claimed in claim 12, wherein said top conductive patch is configured to have a resonant frequency at about 5.9 GHz DSRC and said lower conductive patch is configured to have a resonant frequency at about 1.575 GHz GPS.

21. A dual-band antenna comprising:

a top conductive patch having defined therein a circular slot and four parasitic slots, the four parasitic slots being disposed outside the perimeter of said circular slot and spaced apart therefrom, the four parasitic slots comprising arc slots having a common radial center with the circular slot and having a length less than their radius times $\pi/2$;

a rectangular ground plane parallel to and spaced apart from the top conductive patch;

a polygonal lower conductive patch parallel to and between the top conductive patch and the ground plane;

a first rectangular dielectric substrate disposed between the top conductive patch and the lower conductive patch;

a second rectangular dielectric substrate disposed between the lower conductive patch and the ground plane;

a first feed mechanism adapted to excite the top conductive patch at said common radial center; and a second feed mechanism adapted to excite the lower conductive patch.

22. The dual-band antenna claimed in claim 21, wherein said first and second rectangular dielectric substrates and said rectangular ground plane are square and each is centered with regard to said top conductive patch, and wherein said polygonal lower conductive patch comprises a corner-cut square patch.

23. The dual-band antenna claimed in claim 21, wherein said top conductive patch and said first feed mechanism are configured to give rise to a vertically-polarized radiation pattern, and wherein said lower conductive patch and said second feed mechanism are configured to give rise to a circular-polarized radiation pattern.

* * * * *